US007284345B2

(12) United States Patent
Schenk

(10) Patent No.: US 7,284,345 B2
(45) Date of Patent: Oct. 23, 2007

(54) MILLING DEVICE FOR FLOORS, ROCK, EXCAVATED MATERIAL OR OTHER MATERIAL

(76) Inventor: Jürgen Schenk, Hausmannstr. 34, Stuttgart (DE) 70188

( * ) Notice: Subject to any disclaimer, the term of this patent is extended or adjusted under 35 U.S.C. 154(b) by 0 days.

(21) Appl. No.: 10/472,694

(22) PCT Filed: Dec. 6, 2002

(86) PCT No.: PCT/DE02/04476

§ 371 (c)(1),
(2), (4) Date: Sep. 24, 2003

(87) PCT Pub. No.: WO03/062531

PCT Pub. Date: Jul. 31, 2003

(65) Prior Publication Data

US 2004/0148823 A1 Aug. 5, 2004

(30) Foreign Application Priority Data

Jan. 24, 2002 (DE) ..... 102 02 536

(51) Int. Cl.
*E02F 3/96* (2006.01)

(52) U.S. Cl. ..... 37/403; 37/409; 241/189.2; 299/39.4; 404/90

(58) Field of Classification Search ..... 37/483, 37/468, 409, 410, 903, 324; 299/39.4, 39.2; 404/86, 101, 93, 108, 128, 90, 91; 241/189.1, 241/186, 189.2, 186.4, 101.72
See application file for complete search history.

(56) References Cited

U.S. PATENT DOCUMENTS 540,092 A * 5/1895 Farish ..... 606/137
3,122,398 A * 2/1964 Tucker ..... 241/38
3,891,342 A * 6/1975 Roe ..... 404/128
4,113,023 A * 9/1978 Baskett ..... 171/63
4,259,795 A * 4/1981 Verboom ..... 37/333
4,607,799 A * 8/1986 Currie ..... 241/101.72

(Continued)

FOREIGN PATENT DOCUMENTS

DE 33 11 173 A 9/1984

(Continued)

*Primary Examiner*—Thomas A Beach
(74) *Attorney, Agent, or Firm*—Venable LLP; Ralph P. Albrecht; Ryan M. Flandro

(57) ABSTRACT

The milling apparatus (1) has a bucket with a receiving chamber and has a milling unit with a milling rotor (14). The receiving chamber has a receiving opening (4) and is embodied as a bucket (2). On the bottom of the bucket (2), a through opening (19) is provided, which leads into a milling chamber (12). The milling rotor (14) can move material both into the receiving chamber and out of it again. To achieve both modes of operation, in a first embodiment a drive mechanism rotating in a predetermined direction (D) is provided; a beating arm (16) is associated with the first mode of operation, and a further beating arm (24) is associated with the second mode of operation. In another embodiment, which makes do with a single beating arm (16), the milling unit (54) can be operated in two different working positions via a turner. The positions differ from one another by a 180° rotation about a vertical axis that is perpendicular to the axis of rotation of the milling rotor (14).

29 Claims, 5 Drawing Sheets

U.S. PATENT DOCUMENTS

| | | | | | |
|---|---|---|---|---|---|
| 4,637,753 | A | * | 1/1987 | Swisher, Jr. | 404/90 |
| 4,785,560 | A | * | 11/1988 | Hanson | 37/190 |
| 4,793,732 | A | * | 12/1988 | Jordon | 404/90 |
| 4,803,789 | A | * | 2/1989 | Hackmack | 37/403 |
| 5,154,363 | A | * | 10/1992 | Eddy | 241/30 |
| 5,423,137 | A | * | 6/1995 | Cochran | 37/408 |
| 5,485,689 | A | * | 1/1996 | Jonninen | 37/189 |
| 5,491,914 | A | * | 2/1996 | Negishi | 37/403 |
| 5,619,811 | A | * | 4/1997 | Yrjola | 37/466 |
| 5,887,810 | A | * | 3/1999 | Maruyama | 241/189.1 |
| 5,992,483 | A | * | 11/1999 | Bohnke | 144/24.12 |
| 6,237,865 | B1 | * | 5/2001 | Luttermann et al. | 241/101.72 |
| 6,270,136 | B1 | * | 8/2001 | Dagenais | 294/88 |
| 6,312,194 | B1 | * | 11/2001 | Simons | 405/179 |
| 6,626,499 | B1 | * | 9/2003 | Schenk et al. | 299/39.2 |
| 2004/0050984 | A1 | * | 3/2004 | Rossi, Jr. | 241/101.72 |

FOREIGN PATENT DOCUMENTS

| | | | | |
|---|---|---|---|---|
| DE | 0294 796 | A | | 12/1988 |
| DE | 42 13 523 | A | | 10/1993 |
| DE | 197 27 549 | A | | 2/1999 |
| DE | 19727549 | | * | 2/1999 |
| DE | 19852583 | | * | 5/2000 |
| DE | 199 07 430 | A | | 9/2000 |
| EP | 0 348 510 | A | | 1/1990 |
| EP | 0 408 183 | A | | 1/1991 |
| JP | 09088355 | | * | 3/1997 |
| JP | 10331185 | | * | 12/1998 |
| JP | 11010016 | | * | 1/1999 |
| WO | WO94 06965 | A | | 3/1994 |

* cited by examiner

Be

MILLING DEVICE FOR FLOORS, ROCK, EXCAVATED MATERIAL OR OTHER MATERIAL

BACKGROUND OF THE INVENTION

1. Field of Invention

The invention relates to a milling apparatus for comminuting soil, rock or other material.

2. Description of the Related Art

For excavating soil, suitable digging devices such as excavators are known. However, these are not readily capable of breaking through solid top layers, such as concrete or asphalt, or picking up rock at depth, or mixing the excavated material. Combined digging, mixing and milling equipment has therefore been developed. One such system is known for instance from German Patent Disclosure DE 199 07 430 A1. This system has an excavator bucket that is provided with a miller on its back side. The miller is accommodated in a milling chamber and protrudes from it. Between the milling chamber and the receiving chamber of the excavator bucket, there is an opening, embodied for instance in the form of a sieve. Thus granular material that occurs in the milling process can be collected in the excavator bucket, making rational and versatile work possible. The excavator bucket can be used both like a conventional excavator bucket and additionally as a rock miller.

From German Patent Disclosure DE 42 13 523 A1, a mobile milling loading system is known that is formed by a rock miller in the vicinity of which a pivotable bucket is located. The pivotable bucket serves to receive the material detached by and spun away from the rock miller.

So-called bucket separators are also known, which are capable of receiving a loose mixture of material and separating it into a coarse fraction and a fine fraction. A bucket separator of this kind has a bucket whose bottom is formed by a grate provided with a plurality of rollers. The rollers carry disk elements and rotate in the same or opposite directions. They separate out the fine material, which can fall through between the rollers, while coarse material remains in the bucket.

In practical operation, all the individual tasks named occur to a greater or lesser extent. Sometimes, ditches or trenches have to be excavated, and existing rock can be expected. If the extracted material is to be reincorporated, then often coarse fractions have to be separated out. If other materials, such as material from a demolished building, construction trash or the like that is to be incorporated on site is present, then these materials must sometimes be comminuted and classified. For each of these individual operations, special tools are required.

BRIEF SUMMARY OF THE INVENTION

It is an object of the invention to create an apparatus that can be used in as versatile a way as possible.

The milling apparatus of the invention has a bucket with a receiving chamber and a milling chamber, in which a milling rotor is disposed. Thus the milling apparatus is suitable both for normal digging and for cutting loose solid material. A first beating arm is disposed adjacent to the milling rotor, and the chisels of the milling rotor move past it. This beating arm is disposed such that material cut loose by the milling rotor is fed past the beating arm into the receiving chamber, through the through opening between the milling chamber and the receiving chamber.

According to the invention, the milling apparatus is provided with a further beating arm, which is spaced apart from the first beating arm in terms of the direction of rotation. With this provision, the essential additional possibility is created of comminuting material received by the bucket, using the milling rotor. Thus the milling apparatus makes a first mode of operation possible, in which the milling rotor feeds material through the through opening into the receiving chamber, and a second mode of operation, in which material located in the receiving chamber is milled and ejected from the receiving chamber by the milling rotor. It is thus possible for extracted material, for instance, containing such coarse components as stones, pieces of rock or the like, to be processed. Coarse ingredients are comminuted in the process. Moreover, construction trash, asphalt or the like in material that occurs at a construction site can be comminuted.

Preferably the first beating arm is disposed upstream of the through opening, in terms of the direction of rotation of the milling rotor. It is then operative in the mode of operation in which the material is fed into the receiving chamber of the bucket by the milling rotor. The first beating arm is preferably located on the outside, preferably on an underside of the bucket. It can act as a holding-down device if layers of concrete or asphalt, for instance, are being milled. In that case, the milling apparatus, by means of the beating arm, weighs down on the concrete or asphalt surface while the milling rotor mills off the material that is held down.

The second beating arm is preferably disposed downstream of the through opening, in terms of the direction of rotation of the milling rotor. The beating arm is operative particularly in the mode of operation in which material that through the through opening reaches the milling rotor from the receiving chamber is comminuted by the milling rotor. The beating arm can for instance be disposed in the milling chamber. The beating arms may be embodied as straight, with one straight edge on their side toward the milling rotor. The edge can also be shaped such that it follows the contour of the miller, in order to attain a uniform cutting gap.

In an advantageous embodiment, the first and/or second beating arm can be supported adjustably. For instance, they can be supported adjustably in a radial direction to the milling rotor, in order to enable adjusting the particle size of the milled material produced. With an adjustment of the first beating arm in the circumferential direction of the milling rotor, the milling depth can be adjusted, if the beating arm is disposed outside the milling chamber. An adjustment of the second beating arm in the circumferential direction of the milling rotor can serve to adapt the position of the milling strip to different through openings. The through openings can be embodied adjustably, for instance by means of an optional slide.

It is furthermore possible to support the milling rotor adjustably. For instance, it can be adjustable in a direction perpendicular to the first beating arm, so as to adjust the milling depth.

The two modes of operation can also be achieved with a milling apparatus that has only a single beating arm, but in which the milling rotor is reversible in its direction of rotation. To attain this, the milling rotor is connected for instance to a reversible drive mechanism. In that case, the milling rotor is interchangeable or reversible. In a first operating position, it mills forwards; when it is turned around, it mills backwards, with the drive mechanism moving backward. Two separate milling rotors may be provided and exchanged for one another as needed, instead.

In a more sophisticated embodiment, the milling rotor and the drive mechanism form a structural unit, which is provided with a turner. Thus the milling apparatus works into the receiving chamber in a first operating position and out of the receiving chamber in a second operating position.

Whether by means of additional beating arms or by turning the milling rotor around, in every case a milling apparatus is obtained that has two milling directions, namely into the bucket and out of it.

If needed, a further beating arm can be provided on the back side of the bucket, in order to improve the comminution of material. The beating arm can be provided on a covering hood, which at least in some portions covers the milling rotor protruding out of the milling chamber.

A conveyor device can be disposed in the receiving chamber, serving to reinforce the filling of the receiving chamber when the milling rotor spins material into the receiving chamber. The conveyor device can also serve to deliver material from the receiving chamber to the milling rotor, when the milling rotor is cutting material emerging from the receiving chamber. To that end, the conveyor device can have one or more rollers that are driven to rotate. The rollers can be driven to rotate in the same or opposite directions and can have either a profiled or a smooth surface. Moreover, it can be provided if needed that the positions of the feed rollers are adjustable in the receiving chamber. The roller drives can be derived individually or from a common drive mechanism. Moreover, the drives can be embodied reversibly. Preferably, the rollers extend over the full width of the receiving chamber, and their axes of rotation are preferably oriented parallel to the axis of rotation of the milling rotor.

The through opening can be embodied as a slot, a larger opening, or a sieve. The embodiment as a slot or as a sieve has the advantage that the material is classified on entering the receiving chamber. To assure unhindered operation when material is milled out of the receiving chamber, the through opening can be provided with a removable sieve. A closure device that regulates the size of the through opening can also be provided.

Regardless of whether one, two or three beating arms are provided and how the reversal of the working direction is concretely achieved (with multiple beating arms or by turning the rotor around), a dispenser device can be provided in the milling apparatus. It can in addition or as an alternative discharge into the milling chamber. Thus an additional substance can be added to the material to be processed. This additional substance can for instance be a liquid or a solid (powder). A scattering device that strews the desired additional substance into the receiving chamber or into the milling chamber can be provided. The supply hopper can be disposed on either the milling apparatus or the carrier vehicle, or it can be set up separately.

It is also possible for the receiving opening of the bucket to be provided with a closure device, to prevent granulated material from being ejected from the receiving chamber when the milling rotor feeds material into the receiving chamber. The closure device can be formed by a pivotably supported lid.

It is also possible to connect the milling chamber to an suction extractor. It is furthermore possible to connect the receiving chamber to an suction extractor. The suction extractor can serve to aspirate and separately engage material that has been comminuted by the milling rotor, and/or to minimize dust production.

The suction extractor can also be connected to a hood that optionally covers the rotor. The hood can furthermore be provided with a reamer, which is adjustable in height as needed.

Other advantageous details of embodiments of the invention will become apparent from the drawing, the ensuing description, or the dependent claims. Exemplary embodiments of the invention are shown in the drawing.

DETAILED DESCRIPTION OF THE INVENTION

Figure 1:
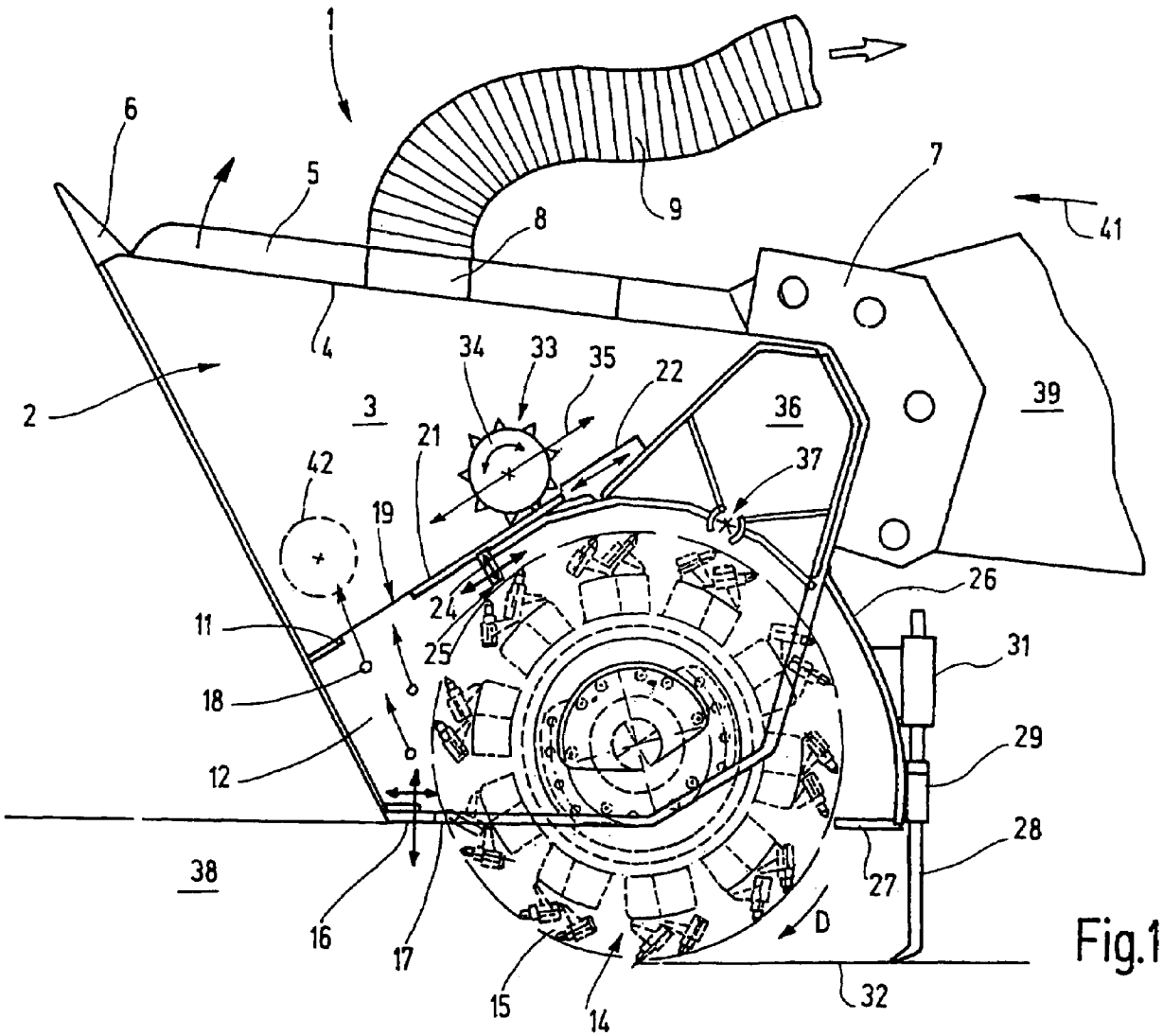
FIG. 1 depicts the milling apparatus in a schematic side view, partly in section, in a first mode of operation.

In FIG. 1, a milling apparatus 1 is shown, which can for instance replace an excavator bucket or the bucket of a wheel loader, or can be guided by some other kind of device. The milling apparatus 1 has a bucket 2, which encloses a receiving chamber 3. At the top of the bucket 2, the receiving chamber has a receiving opening 4, which is closed by a lid 5. Teeth 6 can be embodied on the edge of the receiving opening 4. The lid 5 is pivotably supported on a holder 7. It can be provided with a suction opening 8, to which an suction extractor is connected via a suction line 9. The suction extractor can be supported by the device that carries the milling apparatus 1, or it can be set up separately.

In the bucket 2, a milling chamber 12 in which a milling rotor 14 is rotatably supported is partitioned off via a partition 11. The milling rotor is equipped with tools 15, such as hard metal chisels, which serve to comminute the material and mix it and are inclined in the direction of rotation D. The milling rotor 14 is driven to rotate via a drive mechanism not otherwise shown. The milling rotor 14 can extend over the full width of the bucket or occupy only part of it. It is furthermore possible to provide two milling rotors, which are seated on the same shaft that is supported approximately centrally. In that case, the milling rotors protrude to the right and/or left (in one or both directions) out of the bucket 2 and thus create a milling cut that is wider than the bucket 2. The milling rotor or milling rotors 14 are preferably approximately cylindrical. However, conical, rounded or otherwise-shaped milling rotors can also be used. A beating arm 16 is assigned to the milling rotor 14, preferably located on the underside of the bucket 2, in the immediate vicinity of the milling rotor 14. The beating arm 16 extends over the full width of the milling rotor 14 and is radially spaced apart from it. A cutting gap 17 is formed, which defines the particle size of fragments 18 produced. The beating arm 16 can be supported on the milling rotor 14 so as to be adjustable toward and away from it, to enable adjusting the cutting gap 17. The arrangement can also be made such that the height of the beating arm 16 is adjustable. In this way, the milling depth of the milling rotor 14 can be adjusted.

Figure 4:
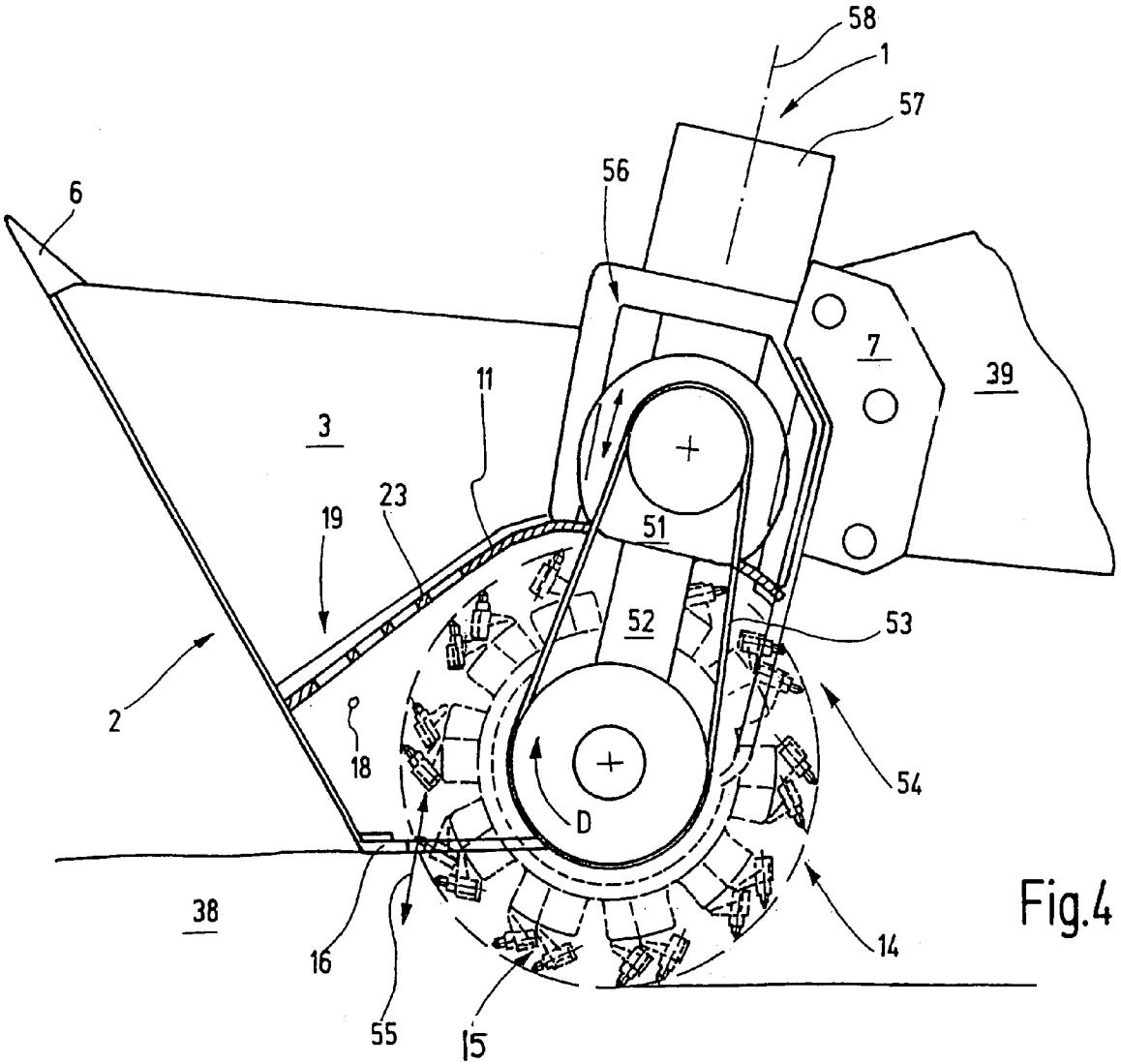
FIG. 4 depicts a modified embodiment of the milling apparatus in a sectional view, in a first mode of operation.

A through opening 19 is located in the partition 11, downstream of the beating arm 16, in terms of the direction of rotation D of the rotor 14. The through opening 19 for instance serves to feed the fragments 18, produced by the milling process, into the receiving chamber 3. The through opening 19 can have an adjustable slide 21 assigned to it that defines the size of the through opening in accordance with the adjustment performed by an adjusting device 22. Alternatively, a fixed or interchangeable screen, rod sieve or the like may be provided. As FIG. 4 shows, a sieve 23 can also be disposed in the through opening 19, in order to classify the material produced by the milling rotor 14 by size. In a modified embodiment, the partition 11 is omitted entirely, so that the receiving chamber 3 and the milling chamber 12 merge with one another.

In the milling chamber 12, there can be a second beating arm 24, downstream of the through opening 19 in terms of the direction of rotation D, that together with the milling rotor 14 defines a gap 25. The beating arm 24 can be fixed or alternatively adjustable. For instance, it can be connected to the slide 21 and supported by it. Alternatively, it can be provided with a separate retaining device and can be supported adjustably in terms of the direction of rotation D or toward and away from the milling rotor 14 as well.

On the back side of the bucket 2, the milling rotor 14 that protrudes there out of the milling chamber can be covered by a hood 26, which serves to prevent the milling rotor 14 from ejecting material from its work region. The hood extends to about the same height as the beating arm 16. On its lower end, it can be provided as needed with a third beating arm 27, which serves to comminute material further.

The hood 26 can also carry a reamer 28, which is formed for instance by a shield which is adjustable in height. It can be supported displaceably in a vertical guide 29 and adjustable by means of an adjusting device 31. The reamer serves to push material, milled away in the continuous milling operation, away from the developing trench bottom 32, so that it can be picked up easily as needed. If no reamer is required, then instead of the hood some other kind of splash protector, for instance in the form of a broom, a rake with steel bristles, or a curtain made up of segments of chain, steel cables, or the like may be used. The splash protector can also be formed by flexible elements, such as plastic elements, rubber elements or the like, such as pieces of old automobile tires.

The suction line 9 can alternatively be connected to the milling chamber 12 or the hood 26.

If needed, a conveyor device 33 to which at least one rotatably disposed roller 34 belongs may be disposed in the receiving chamber 3. The roller 34 for instance extends parallel to the milling rotor 14, parallel to a side wall of the receiving chamber 3, or obliquely across the full width of the receiving chamber 3. It is profiled (that is, provided with spikes or cleats or ribs or other protrusions), or is smooth. It can be connected to a drive mechanism, with which it can be set into rotation (forward or backward) as needed. The roller 34 can also be supported displaceably, as indicated by an arrow 35, in order to shift it into whichever is the appropriate working position. It serves to reinforce the filling and evacuation of the receiving chamber 3. If needed, further rollers may be provided, to move the material located in the receiving chamber 3.

The bucket 2 can moreover be provided with a supply chamber 36, which contains additional materials such as lime, cement, fibrous material, sawdust, or even liquids. The supply chamber 36 is connected to a dispenser device 37, which for example is embodied as a scattering device. The dispenser device 37, in the exemplary embodiment presented here, discharges into the milling chamber 12 above the milling rotor 14, that is, downstream of the through opening 19 in terms of the direction of rotation D. The dispenser device can also be connected to the roller 34 (or 42) and can have outlet openings on its jacket. Alternatively or in addition, a dispenser device discharging into the receiving chamber 3 may be provided. It is furthermore possible to provide a dispenser device that discharges in the vicinity of the lower beating arm 16, that is, upstream of the through opening 19 in terms of the direction of rotation D. To avoid dust, one or more water-spraying devices can also be provided, which create a water curtain or water mist in the surroundings of the milling apparatus 1.

Figure 3:
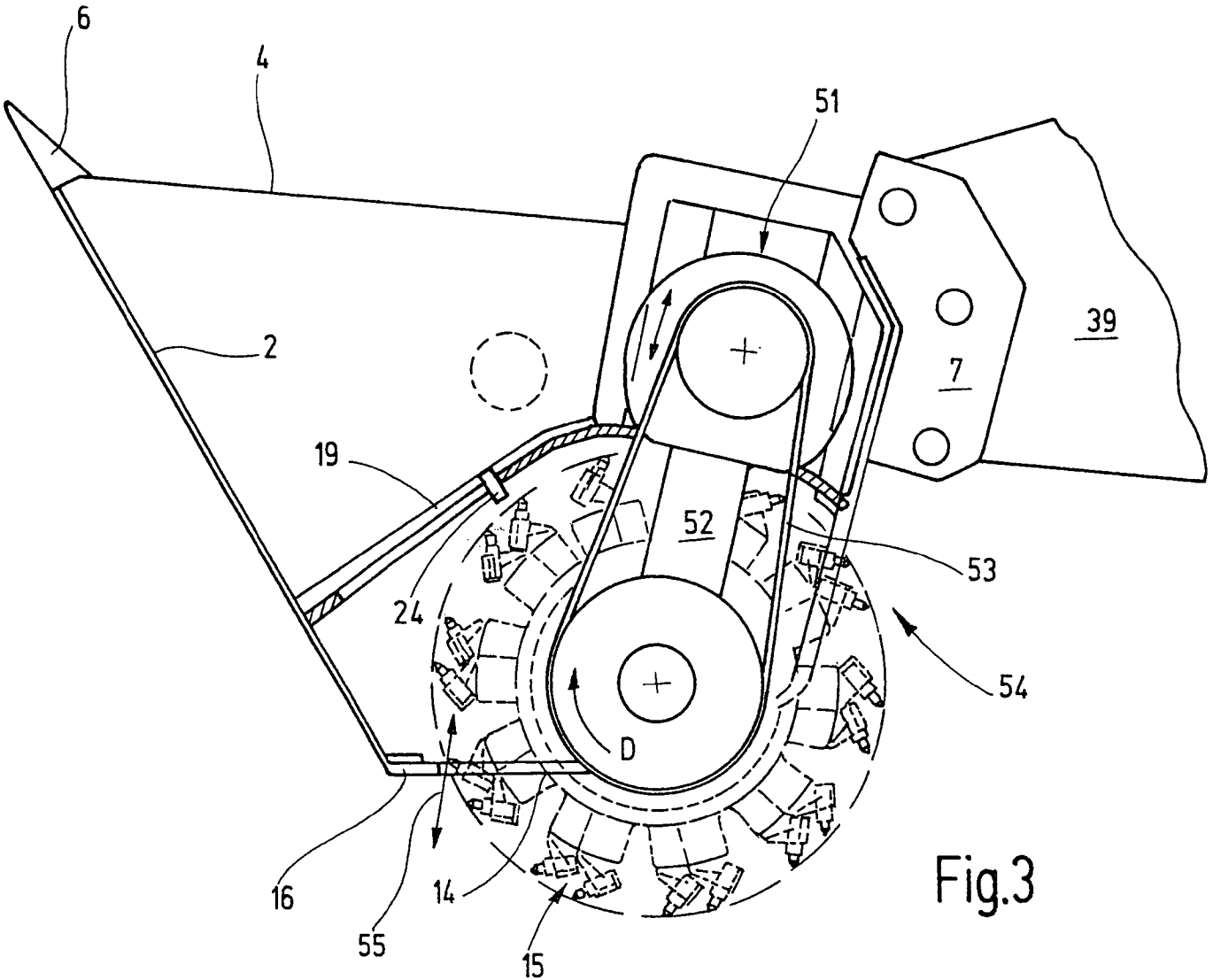
FIG. 3 depicts the milling apparatus of FIGS. 1 and 2 in a sectional view.

As FIG. 3 shows, the milling rotor 14 is rotatably supported on a mount 52 that is connected to a drive mechanism 51. For forced transmission between the drive mechanism and the milling rotor 14, a chain 53 is used. The milling unit 54 thus formed is supported adjustably in an approximately vertical direction 55 with respect to the working position of FIG. 3. As an alternative to the chain 53, other gear means may be used. The drive mechanism 51 can also be disposed on the miller axle.

The milling apparatus 1 described thus far functions as follows:

The milling apparatus 1 shown in FIG. 1 is used in its first mode of operation for milling a solid ground layer 38, for instance. This can for instance be a layer of asphalt, a layer of frozen soil, a layer of concrete, or the like. The rotor, driven by a drive mechanism not otherwise shown, rotates clockwise (in the direction of rotation D). The milling apparatus 1 is retained in the position shown in FIG. 1 by a carrier 39 and is moved slowly from right to left (direction of the arrow 41). The beating arm 16 slides on the ground layer 38. The bucket weighs down on the ground via the beating arm. The rotating milling rotor 14 cuts fragments out of the existing ground layer 38 that are thrown upward, through the cutting gap 17. In the process, the fragments pass through the through opening 19 into the receiving chamber 3, which as a result gradually fills up. The filling can be reinforced by the roller 34 and optionally by a further roller 42, shown in dashed lines, which may also belong to the conveyor device 33.

If there is no suction line 8, the receiving chamber 3 fills gradually. Once it is sufficiently full, the bucket can be emptied, by being moved away from the work site by the carrier 39 and emptied onto the bed of a truck, for instance. The bucket 2 can also be used for normal digging work. For instance, loose material left on the bottom 32 of the trench can be picked up with the bucket 2. If softer ground layers are located under the ground layer 38, they can be picked up directly with the bucket 2.

If the suction device is powerful enough to extract the fragments 18 from the receiving chamber 3 by suction via the suction line 9, then work can be done continuously. The fragments 18 produced are extracted by suction from the receiving chamber 3 and engaged separately. Only larger pieces, if they are to reach the inside of the receiving chamber 3, remain in it.

Figure 2:
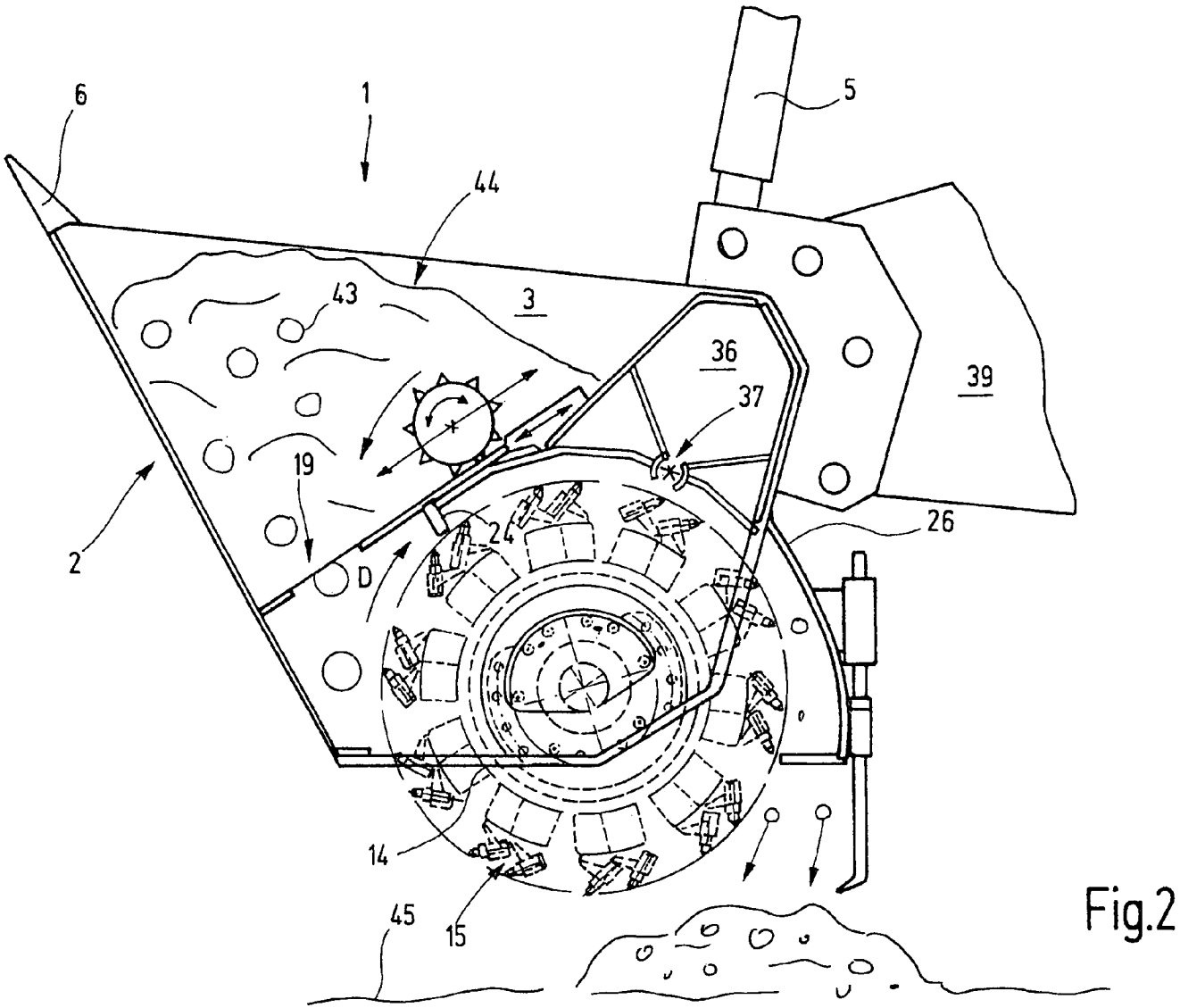
FIG. 2 depicts the milling apparatus of FIG. 1 in a schematic side view, in a second mode of operation.

FIG. 2 illustrates a fundamentally different, second mode of operation, in which the milling apparatus 1 is used to comminute coarse components 43 that are present in a mixture 44 of material. This mixture has for instance been picked up by the bucket 2, as with an excavator bucket. The carrier 39 now keeps the milling apparatus 1 above the ground 45. The milling rotor 14 rotates in the direction of rotation D. The mixture 44 of material reaches the milling rotor 14 through the through opening 19. If the partition 11 has been omitted or removed, even material that is in very large pieces or is viscous can be processed. The milling rotor 14 comminutes the coarse components 43 at the beating arm 24. Finer components are simply fed by the milling rotor 14. The resultant mixture of fine components and comminuted coarse components is thrown downward by the milling rotor 14. The hood 26 prevents excessive spraying in the work of the milling rotor 14. In this process, the dispenser device 37 can also be put into operation; it adds an additional material from the supply chamber 36 to the milled material. Instead of the supply chamber 36, a delivery line may be provided, by way of which the additional material is delivered to the dispenser device 37 from a supply set up at a remote place, or a supply that is located on the carrier vehicle.

The milling apparatus presented can thus be used not only for digging work but also for pure material processing, such as breaking, comminuting, mixing, adding binder, and adding water to bind dust.

FIG. 4 illustrates a modified embodiment of the milling apparatus 1 of the invention. Unless differences are expressly referred to below, the description of the milling apparatus 1 of FIGS. 1 and 2 applies accordingly, on the basis of the same reference numerals.

The milling apparatus 1 of FIG. 4 can be provided with a sieve 23 at its through opening 19, or with an unobstructed through opening. If needed, the conveyor device 33, not shown, and the lid 5 can be provided; it is equally possible for the dispenser device 37 along with the hood 26 and the reamer 28 to be provided. The supply hopper 36 of the dispenser device 37 is located to the right and left, next to a drive mechanism 51 provided for driving the milling rotor 14, or in other words upstream and downstream of this drive device 51 in FIG. 4. The drive mechanism 51 is disposed approximately centrally in the bucket 2, that is, approximately in the region of the holder 7 to which the carrier 39 is attached. It drives the milling rotor, rotatably supported on a mount 52, via a chain 53 or other gear means. The drive mechanism 51 is a hydraulic motor, for instance.

Together with the rotor 14, the drive mechanism 51 forms a milling unit 54, which is linearly adjustable in its entirety in a direction 55 extending transversely (approximately perpendicularly) to the beating arm 16. The direction 55 is approximately perpendicular to one of the flat sides of the beating arm 16. In terms of the working direction shown in FIG. 1, this means an adjustment in the height of the milling apparatus 54. The milling depth can thus be regulated. To that end, a corresponding guide and adjusting device 56 is disposed in the bucket 2. The adjustment is accomplished for instance by a hydraulic adjusting device 57.

The milling apparatus 1 shown in FIG. 4 can work as a ground milling assembly in breaking through ground layers 38, as shown in FIG. 4. The milling rotor can also be used at a greater depth to cut apart solid layers located there, such as layers of rock. Material that has been broken loose is fed in the form of fragments 18 through the through opening 19 or sieve 23 into the receiving chamber 3.

Figure 5:
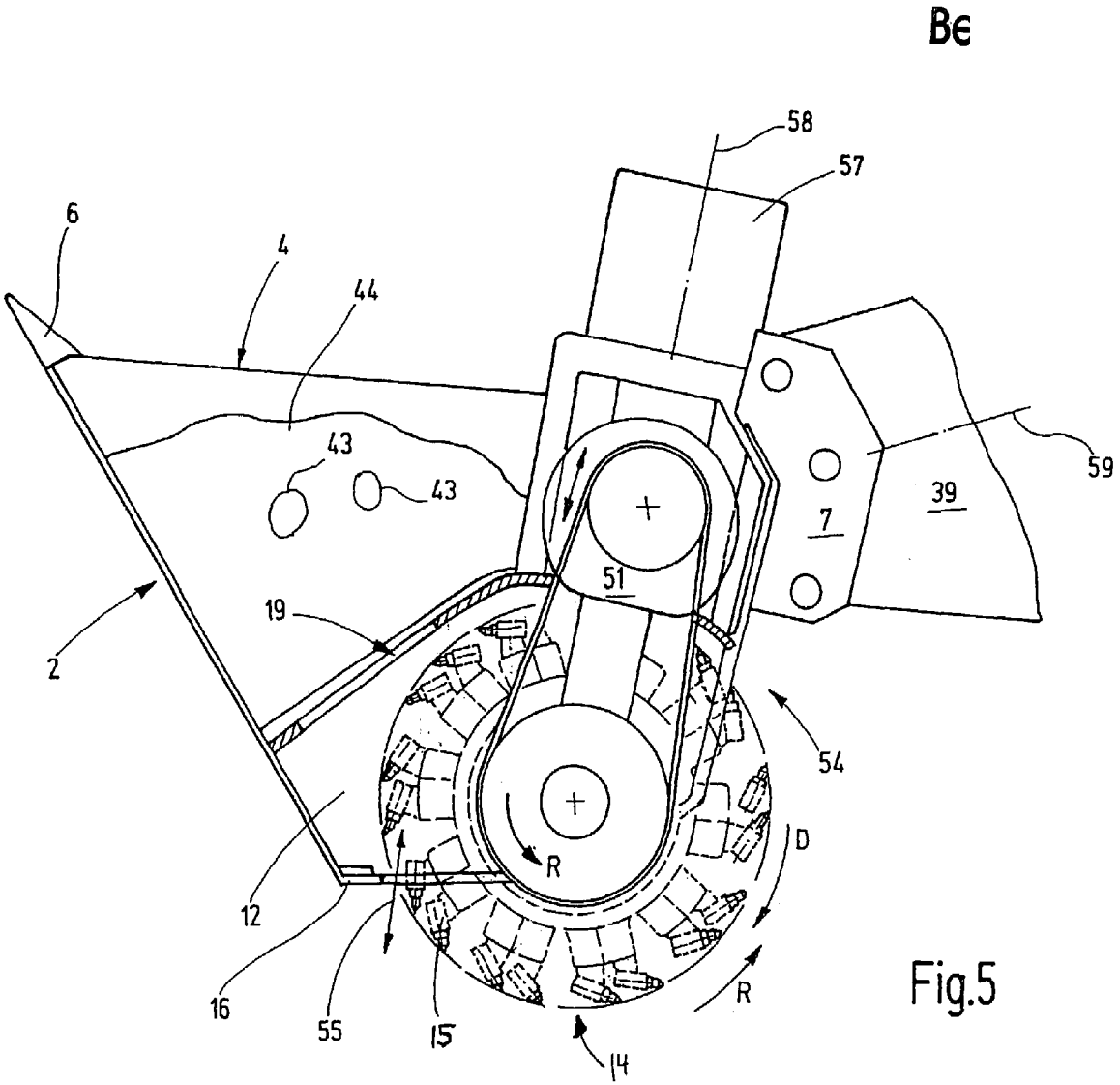
FIG. 5 depicts the milling apparatus of FIG. 4 in a second mode of operation.

If the milling apparatus 1 is to be used to comminute material picked up by the bucket 2, then the hydraulic adjusting device 57 is triggered in such a way that the milling rotor 14 is moved out of the milling chamber 12 in the direction 55. It is then turned around, by rotation of 180° about a vertical axis 58 and is retracted into the milling chamber 12 again. It is then in the position shown in FIG. 5, in which the tools 15 point counter to the original direction of rotation D and thus in the reverse direction of rotation R. Thus the entire milling unit 54 has been turned around. Now the mixture of material 44 located in the receiving chamber 3 can pass through the through opening 19 to reach the milling rotor 14. The milling rotor rotates in direction R, the reverse of direction of rotation D. The coarse components 43 are comminuted by the tools 15 of the milling rotor 14 at the beating arm 16. Once again, by means of the dispenser device 37, additional material can be added.

Rollers of the conveyor device 33 that are provided in the receiving chamber 3 can reinforce the feeding of material, if necessary. Moreover, if the through opening 19 is large enough, they can mesh with the milling rotor 14 as they work.

The rollers 34, 42 and the milling rotor 14 can be embodied of different sizes. They can also rotate at different rotary speeds, either in meshing or nonmeshing fashion. Furthermore, as needed they can operate in the same direction or in contrary directions. Furthermore, a turner can be provided between the carrier 39 and the holder 7, in order to pivot the milling apparatus 1 on the carrier 39. The pivot axis is indicated by a dot-dashed line 59 in FIG. 5.

A versatile milling apparatus 1 has a bucket 2 with a receiving chamber 3 and has a milling unit 54 with a milling rotor 14. The receiving chamber 3 has a receiving opening 4 and is embodied as a bucket 2. On the bottom of the bucket 2, a through opening 19 is provided, which leads into a milling chamber 12. The milling rotor 14 disposed in it can move material 44 both into the receiving chamber 3 and out of it again. To achieve both modes of operation, in a first embodiment a drive mechanism 51 rotating in a predetermined direction D is provided; a beating arm 16 is associated with the first mode of operation, and a further beating arm 24 is associated with the second mode of operation. In another embodiment, which makes do with a single beating arm 16, the milling unit 54 can be operated in two different working positions via a turner. The positions differ from one another by a 180° rotation about a vertical axis 58 that is perpendicular to the axis of rotation of the milling rotor 14. Alternatively, it is possible to turn only the milling rotor 14 around, or to replace it with a milling rotor mirror-symmetrical to it. In that case, the drive mechanism 51 is embodied reversibly.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

The invention claimed is:

1. A milling apparatus for comminuting coarse material, the milling apparatus comprising:

a bucket;

a receiving chamber in the bucket having a receiving opening on one side and at least one through opening on an opposite side;

a milling chamber in the bucket communicating with the receiving chamber via the through opening;

a milling rotor disposed in and protruding from the milling chamber, the milling rotor driven to rotate in a direction of rotation and including tools arranged for comminuting material;

a first beating arm disposed adjacent to the milling rotor; and a second beating arm associated with the milling rotor and spaced apart from the first beating arm in the direction of rotation, the through opening arranged between the first and second beating arms in the direction of rotation of the milling rotor, wherein the milling apparatus has at least two modes of operation, the first beating arm cooperating with the milling rotor to mill a solid ground layer during a first mode of operation, and the second beating arm cooperating with the milling rotor to comminute material entering the milling chamber from the receiving chamber via the through opening during a second mode of operation.

2. The milling apparatus of claim 1, wherein the first beating arm is disposed upstream of the through opening, in terms of the direction of rotation of the milling rotor.

3. The milling apparatus of claim 1, wherein the first beating arm is disposed on an outside of the bucket.

4. The milling apparatus of claim 1, wherein the second beating arm is disposed downstream of the through opening, in terms of the direction of rotation of the milling rotor.

5. The milling apparatus of claim 1, wherein the second beating arm is disposed in the milling chamber.

6. The milling apparatus of claim 1, wherein the first beating arm is retained adjustably.

7. The milling apparatus of claim 1, wherein the second beating arm is retained adjustably.

8. The milling apparatus of claim 1, wherein the milling rotor is retained adjustably.

9. The milling apparatus of claim 8, wherein the milling rotor is retained linearly adjustably in a direction that is at approximately a right angle to a flat side of the first beating arm.

10. The milling apparatus of claim 1, the bucket further including a third beating arm disposed opposite the first beating arm relative to the milling rotor.

11. The milling apparatus of claim 1, further including a third beating arm disposed on an outside of the bucket.

12. The milling apparatus of claim 1, further including at least one conveyor device disposed in the receiving chamber.

13. The milling apparatus of claim 12, wherein the conveyor device has at least one roller that is driven to rotate.

14. The milling apparatus of claim 12, wherein the conveyor device is disposed next to the through opening.

15. The milling apparatus of claim 12, wherein the conveyor device is disposed adjustably in the receiving chamber.

16. A milling apparatus for comminuting coarse material, the milling apparatus comprising:

a bucket;

a receiving chamber in the bucket having a receiving opening on one side and at least one through opening on an opposite side;

a milling chamber in the bucket communicating with the receiving chamber via the through opening; and a milling unit for comminuting material, the milling unit disposed in and protruding from the milling chamber and including a drive mechanism and a reversible milling rotor.

17. The milling apparatus of claim 1, wherein the through opening is a sieve.

18. The milling apparatus of claim 1, further including a closure device associated with the through opening.

19. The milling apparatus of claim 1, further including a dispenser device associated with the bucket.

20. The milling apparatus of claim 19, wherein the dispenser device includes at least one orifice disposed in the receiving chamber.

21. The milling apparatus of claim 19, wherein the dispenser device includes at least one orifice disposed above or next to the milling rotor.

22. The milling apparatus of claim 19, wherein the dispenser device communicates with a supply chamber provided on the milling apparatus.

23. The milling apparatus of claim 19, wherein the dispenser device communicates via a line with a supply chamber remote from the milling apparatus.

24. The milling apparatus of claim 1, wherein the receiving opening includes a closure device.

25. The milling apparatus of claim 1, wherein the receiving chamber communicates with a suction extractor.

26. The milling apparatus of claim 1, wherein the milling chamber communicates with a suction extractor.

27. The milling apparatus of claim 1, wherein the milling rotor, in at least one region of its circumference, is covered with a hood retained on the bucket.

28. The milling apparatus of claim 27, further including a reamer disposed on the hood.

29. A milling apparatus for comminuting coarse material, the milling apparatus comprising:

a bucket including a receiving chamber, the bucket further including a receiving opening on one side of the bucket leading into the receiving chamber and at least one through opening on the opposite side of the bucket;

a milling chamber communicating with the receiving chamber via the through opening;

a milling rotor adjustably retained in and protruding from the milling chamber, the milling rotor driven to rotate in a direction of rotation and including tools arranged for comminuting material;

a first beating arm disposed adjacent to the milling rotor; and a second beating arm associated with the milling rotor and spaced apart from the first beating arm in the direction of rotation.

* * * * *

UNITED STATES PATENT AND TRADEMARK OFFICE

CERTIFICATE OF CORRECTION

PATENT NO. : 7,284,345 B2
APPLICATION NO. : 10/472694
DATED : October 23, 2007
INVENTOR(S) : Jürgen Schenk It is certified that error appears in the above-identified patent and that said Letters Patent is hereby corrected as shown below:

IN THE CLAIMS:

Column 9, line 55, claim 16 delete the term "and" such that the line reads:

receiving chamber via the through opening;

Column 10, line 4, claim 16 insert the following after the term "rotor":

--; and a turner associated with the milling unit, the turner being adapted to rotate the milling rotor 180 degrees about a vertical axis perpendicular to an axis of rotation of the milling rotor.--

Signed and Sealed this

Thirteenth Day of May, 2008

JON W. DUDAS
*Director of the United States Patent and Trademark Office*